United States Patent [19]

Link

[11] 4,361,990

[45] Dec. 7, 1982

[54] SANDPAPER HOLDER

[75] Inventor: Reinhold G. Link, Dayton, Ohio

[73] Assignee: Linkspiel, Inc., Dayton, Ohio

[21] Appl. No.: 210,980

[22] Filed: Nov. 28, 1980

[51] Int. Cl.[3] ..... B24D 15/04

[52] U.S. Cl. ..... 51/392

[58] Field of Search ..... 51/391, 392, 393, 359, 51/370

[56] References Cited

U.S. PATENT DOCUMENTS

| | | | |
|---|---|---|---|
| 1,181,123 | 5/1916 | Edenborough | 51/392 |
| 2,328,886 | 9/1943 | Andrews | 51/392 |
| 2,645,064 | 7/1953 | Pavlovic | 51/392 |
| 2,802,314 | 8/1957 | Mandzick | 51/393 |
| 3,648,418 | 3/1972 | Churchich | 51/392 |
| 3,775,923 | 12/1973 | Martin | 51/392 |

*Primary Examiner*—Harold D. Whitehead

*Attorney, Agent, or Firm*—Biebel, French & Nauman

[57] ABSTRACT

A sanding tool includes a holder used in combination with a narrow strip of sandpaper and having a handle portion and a spatulate portion extending from the handle portion which terminates in a squared-off end. The spatulate portion has a first slot therethrough adjacent the squared-off end and extending transversely of the spatulate portion, and a second slot in between the first slot and the handle portion so that the sandpaper strip can be passed through the second slot, over the end, through the first slot, and back through the second slot.

3 Claims, 4 Drawing Figures

SANDPAPER HOLDER

BACKGROUND OF THE INVENTION

1. Field of the Invention

The invention relates to sanding tools, and more particularly, to a tool for holding strips of sandpaper.

2. Prior Art

There are many devices known in the art for gripping sheets which carry abrasive material on one side, collectively referred to as sandpaper. These devices typically provide a firm backing surface for supporting the sandpaper and a handle or other means attached to the supporting surface so that the tool may be conveniently grasped by a user.

For example, U.S. Pat. No. 1,181,123 is directed to a holder for sandpaper which is used in combination with a standard file. The sandpaper, which is in the form of an elongated strip, is held at its ends by two grips which have parallel slots to receive the ends of the sandpaper strip. The grips include prongs for engaging the end of the file adjacent the handle so that the strip of sandpaper extends along one side of the file, over the end, and back along the opposite side of the file. Sandpaper holders of this type possess a disadvantage in that it is not possible to advance the sandpaper relative to the supporting surface once it has become worn through use in one area. With the aforementioned device, the entire strip of sandpaper must be replaced after it has become used.

Another form of sandpaper holder is disclosed in U.S. Pat. No. 2,802,313. This patent discloses a holder having a generally U-shaped body in which the ends of the U abut each other with sufficient clamping force to pinch the ends of a strip of sandpaper placed therebetween. A strip of sandpaper is grasped by the holder so that the leading and trailing edges of the strip are placed in between the ends of the U, the strip extends about the outer surface of the U so that the abrasive side of the strip faces outward. This type of device can receive a coil of strip sandpaper within the concave portion of the U so that the sandpaper may be advanced as it becomes worn.

This device possesses an inherent disadvantage in that the entire outside surface of the holder is covered with sandpaper with the abrasive side outward so that the hand of the user may become abraded after grasping the holder for extended lengths of time. In addition, the strip of sandpaper is secured to the holder only at its ends and thereby provides a length of strip sandpaper which is unsupported and may slip relative to the holder thereby reducing the effective abrasiveness of the sandpaper.

Another type of sandpaper holder is disclosed in U.S. Pat. No. 2,429,550. This sandpaper holder consists of a flat spatulate portion which includes a handle portion extending outward from it. The spatulate portion has a raised portion with upper and lower notches which extend transversely of the spatulate portion and are shaped to receive first and second tubes joined by a loop of wire. A strip of sandpaper is held against the raised portion by clamping the ends of the strip between the tubes and notches.

This device possesses disadvantages in that it is difficult to advance the sandpaper relative to the spatulate portion once it has been worn down and there is no space provided for storage of the unused portion of the strip sandpaper prior to its being advanced to the spatulate portion. In addition, the arrangement of the spatulate portion and the tubes results in a segment of unsupported sandpaper which may slide relative to the spatulate portion and reduce the effective abrasiveness of the sandpaper.

Accordingly, there is a need for a sanding tool having a holder that is of simple and low cost construction, which can grasp and hold a portion of a strip of sandpaper to provide a contact surface which has little movement relative to the support surface, and which provides for storage of the unused portion of the strip sandpaper prior to its being advanced to the portion of the holder which supports the sandpaper as it is being used without abrading the hand of the user.

SUMMARY OF THE INVENTION

The sanding tool of the present invention includes a holder having a simple, one-piece construction and may be fabricated from any relatively inexpensive hard plastic material, an improvement over prior art sandpaper holders requiring many components to secure the sandpaper to the holder. In addition, the sandpaper holder holds a strip of sandpaper over a firm backing surface so that there is little relative movement of the sandpaper relative to the backing surface thereby eliminating the reduction in effective abrasiveness of the sandpaper being used.

The sandpaper holder of the present invention can accommodate a length of unused strip sandpaper in such a manner that it does not abrade against the hand of the user, an advantage over those prior art sandpaper holders in which the abrasive side of the sandpaper extends about the body of the holder and faces outward. The unused portion of the strip sandpaper can be easily advanced to the backing surface of the holder without the need of adjusting any sandpaper retaining elements, an improvement over prior art holders which require the use of sandpaper retaining elements.

The sanding tool of the present invention includes a holder which is used in combination with a thin flexible strip of a sandpaper, at least one side of which carries an abrasive, and consists of an elongated handle portion and a spatulate portion extending from the handle portion and terminating in a squared-off end. The spatulate portion includes a first slot therethrough, adjacent the squared-off end, and a second slot positioned in between the first slot and the handle portion. The first and second slots are preferably parallel to each other and to the squared-off end.

A strip of sandpaper is passed through the second slot, over the squared-off end, through the first slot, and back through the second slot. In this fashion, the strip of sandpaper is doubled over against itself on the spatulate portion so that the spatulate portion provides a firm backing surface for the sandpaper which allows little movement of the sandpaper relative to the spatulate portion. The unused portion of the strip sandpaper lays along the back side of the handle portion so that the side of the strip carrying the abrasive faces the handle. During use, the hand of the user grasps the handle portion and the nonabrasive side of the strip sandpaper extends along the palm of the hand. To provide increased force on the spatulate portion, it may be desirable for the user to place his index finger against the back side of the spatulate portion opposite the backing surface. In this fashion, the sandpaper holder may be positioned at an acute angle to the surface to be sanded, in which case the firm backing surface supports the sandpaper. The holder may also be held substantially normal to the surface, in which case the squared-off end provides the support for the sandpaper.

When the sandpaper which overlaps the backing surface has become worn through use, the user merely urges the unused portion forward through the second slot thereby loosening the engagement of the sandpaper with the slots and squared-off ends. The user then merely pulls the end of the strip sandpaper back along the handle portion and tears off the used strip. By pulling the remaining portion of the unused strip taut against the handle portion, the strip sandpaper once again firmly engages the slots and squared-off end of the spatulate portion and the holder is ready for use. Accordingly, it is an object of the present invention to provide a sanding tool comprising a sandpaper holder which is of simple one-piece construction: to provide a sandpaper holder which holds strip sandpaper over a firm backing surface so that there is little movement of the sandpaper relative to the backing surface; to provide a sanding tool which can accommodate a length of unused strip sandpaper in such a fashion that it does not abrade against the hand of the user; and to provide a sanding tool in which the unused portion of the strip sandpaper can be easily advanced to the backing surface.

Other objects and advantages of the invention will be apparent from the following description, the accompanying drawings, and the appended claims.

DETAILED DESCRIPTION OF THE PREFERRED EMBODIMENT

Figure 1:
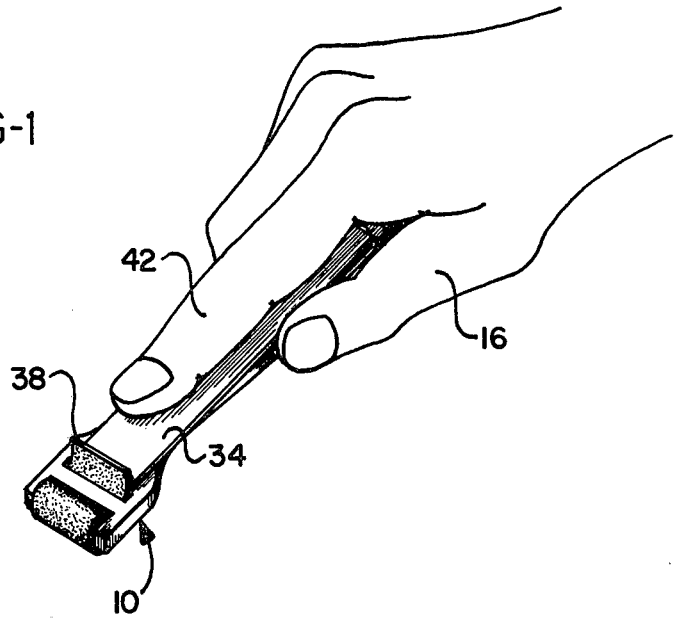
FIG. 1 is a perspective view of the sanding tool of the present invention grasped by the hand of a user.
Figure 2:
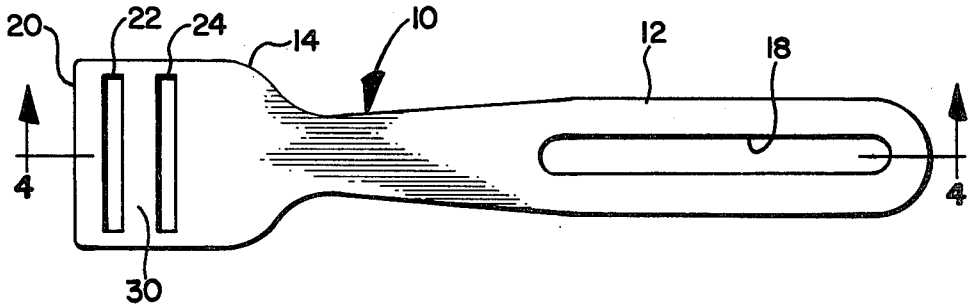
FIG. 2 is a plan view of the sandpaper holder of FIG. 1.

As best shown in FIGS. 1 and 2, the sanding tool of the present invention comprises a holder, generally designated 10, including a handle portion 12 and a spatulate portion 14. The handle portion 12 is of an elongated shape and sized so that it can be grasped easily by the hand 16 of a user.

Figure 3:
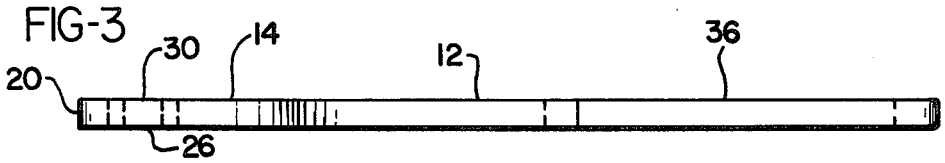
FIG. 3 is a side elevation of the sandpaper holder of FIG. 1.

As shown in FIGS. 2 and 3, the handle portion 12 may include an elongated opening 18 which facilitates the hanging of the holder 10 on a hook in a work area. The spatulate portion 14 extends from the handle portion 12 and terminates in a squared-off end 20. The spatulate portion 14 includes a first slot 22 positioned adjacent the end 20 and a second slot 24 positioned between the first slot and the handle portion. The first slot 22 and second slot 24 extend transversely of the spatulate portion 14 and are positioned to be parallel to each other and to the end 20. The spatulate portion 14 also provides a firm backing surface 26 for supporting the strip sandpaper 28 to be used which is opposite a back side 30.

Figure 4:
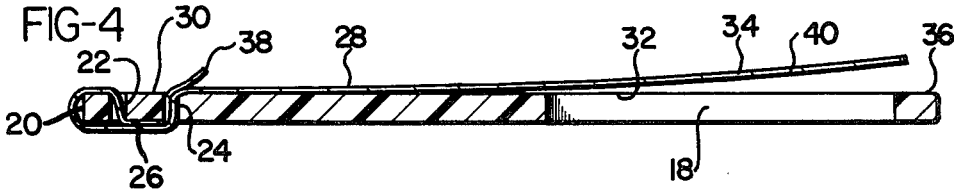
FIG. 4 is a side elevation, in section, of the sandpaper holder taken at line 4—4 of FIG. 2 and showing a length of strip sandpaper engaging the slots.

As best shown in FIGS. 1 and 4, the strip sandpaper 28, preferably having an abrasive side 32 and a nonabrasive side 34, is placed along the back side 36 of the handle portion 12. It should be understood that the sandpaper holder 10 can be used with any type of thin flexible sheet which carries an abrasive on its surface. For convenience, the term "sandpaper" will be used in its collective sense and refer to any such type of sheet.

The leading edge 38 of the strip sandpaper 28 is first inserted through the second slot 24 and wrapped around the end 20 of the spatulate portion 14. The leading edge 38 is then inserted through the first slot 22 and then passed back up through the second slot 24. By pulling the unused portion 40 of the sandpaper 28 taut along the handle portion 12, the doubling over of the strip sandpaper against itself causes it to become taut against the firm backing surface 26 and substantially eliminates movement of the sandpaper relative to the backing surface. The sandpaper holder now can be used to sand the desired object, using that portion of the strip sandpaper 28 which overlays the backing surface 26 of the end 20 of the spatulate end 14. To increase the force of the working surface of the sandpaper 28 against the desired workpiece, the index finger 42 of the user may be extended and placed against either the nonabrasive side 34 of the strip sandpaper 28, which extends along the handle portion 12, or against the back side 30 of the spatulate portion 14.

After the strip sandpaper 28 has become worn in the areas overlaying the backing surface 26 and end 20 of the spatulate portion 14, the strip is advanced by first urging the unused portion 40 along the handle portion 12 toward the spatulate portion 14. This loosens the portion of the sandpaper overlaying the backing surface 26 and allows the leading edge 38 of the sandpaper to be pulled upward away from the second slot 24 thereby advancing the worn portion of the sandpaper past the backing surface and squared-off end. After the strip sandpaper 28 has been sufficiently advanced, the portion of the strip sandpaper adjacent the leading edge 38 can be torn or cut off and the unused portion 40 can be pulled taut against the handle portion 12 to once again secure the sandpaper firmly against the backing surface 26 and end 20.

There are many advantages inherent in this embodiment of the invention. The holder 10 consists of a simple, one-piece construction and can be fabricated from any rigid material such as nylon or other polyamides, metal, or wood. The unused length of strip sandpaper extends along the handle portion of the holder beneath the palm of the hand so that the nonabrasive side of the sandpaper faces the palm, thereby eliminating any abrasion of the sandpaper against the hand of the user. Finally, the arrangement of slots within the spatulate portion of the holder provides a means of securing the strip sandpaper against a firm backing surface to reduce movement of the sandpaper relative to the backing surface and allows the strip sandpaper to be advanced easily when the portion overlaying the backing surface becomes worn.

While the form of apparatus herein described constitutes a preferred embodiment of this invention, it is to be understood that the invention is not limited to this precise form of apparatus, and that changes may be made therein without departing from the scope of the invention.

What is claimed is:

1. A sanding tool comprising:

a holder having a handle portion and a spatulate portion extending from said handle portion and having an end opposite said handle portion, said spatulate portion having a firm backing surface, a first transverse slot therethrough adjacent said end, and a second transverse slot therethrough between said first slot and said handle portion; and a flexible strip of material, at least one side thereof coated with an abrasive, said strip extending along said handle portion, through said second slot, over said backing surface and said end, through said first slot, and back through said second slot, such that said strip is held in position on said holder during use, yet may be adjusted to bring a different portion over said backing surface and end.

2. The holder of claim 1 wherein said slots are parallel to each other.

3. The tool of claim 1 wherein said end is squared off and is parallel to said first and second slots.

* * * * *